United States Patent [19]

Wall

[11] 3,960,155

[45] June 1, 1976

[54] HAIR STYLING DEVICE

[76] Inventor: Albert Wall, 515 S. Crescent Ave., Lodi, Calif. 95240

[22] Filed: Sept. 19, 1975

[21] Appl. No.: 614,915

[52] U.S. Cl. ..... 132/9; 15/188

[51] Int. Cl.[2] ..... A45D 1/00

[58] Field of Search ..... 132/9, 84; 15/104.94, 15/188, 227

[56] References Cited

UNITED STATES PATENTS

| | | | |
|---|---|---|---|
| 2,686,325 | 8/1954 | Silver | 15/188 |
| 2,966,691 | 1/1961 | Cameron | 15/104.94 |

*Primary Examiner*—G. E. McNeill

*Attorney, Agent, or Firm*—Flehr, Hohbach, Test, Albritton & Herbert

[57] ABSTRACT

A hair styling device includes finger coverings of semi-rigid material carried on adjacent fingers of the hand of a barber in which one of the finger coverings is formed to include a curved lip to lie in substantially parallel relation alongside the convex curvature of the other finger covering. One of the two finger coverings carries means for establishing a predetermined, spaced relation between the two finger coverings as hair is drawn through the gap defined between the two finger coverings.

11 Claims, 7 Drawing Figures

FIG_1
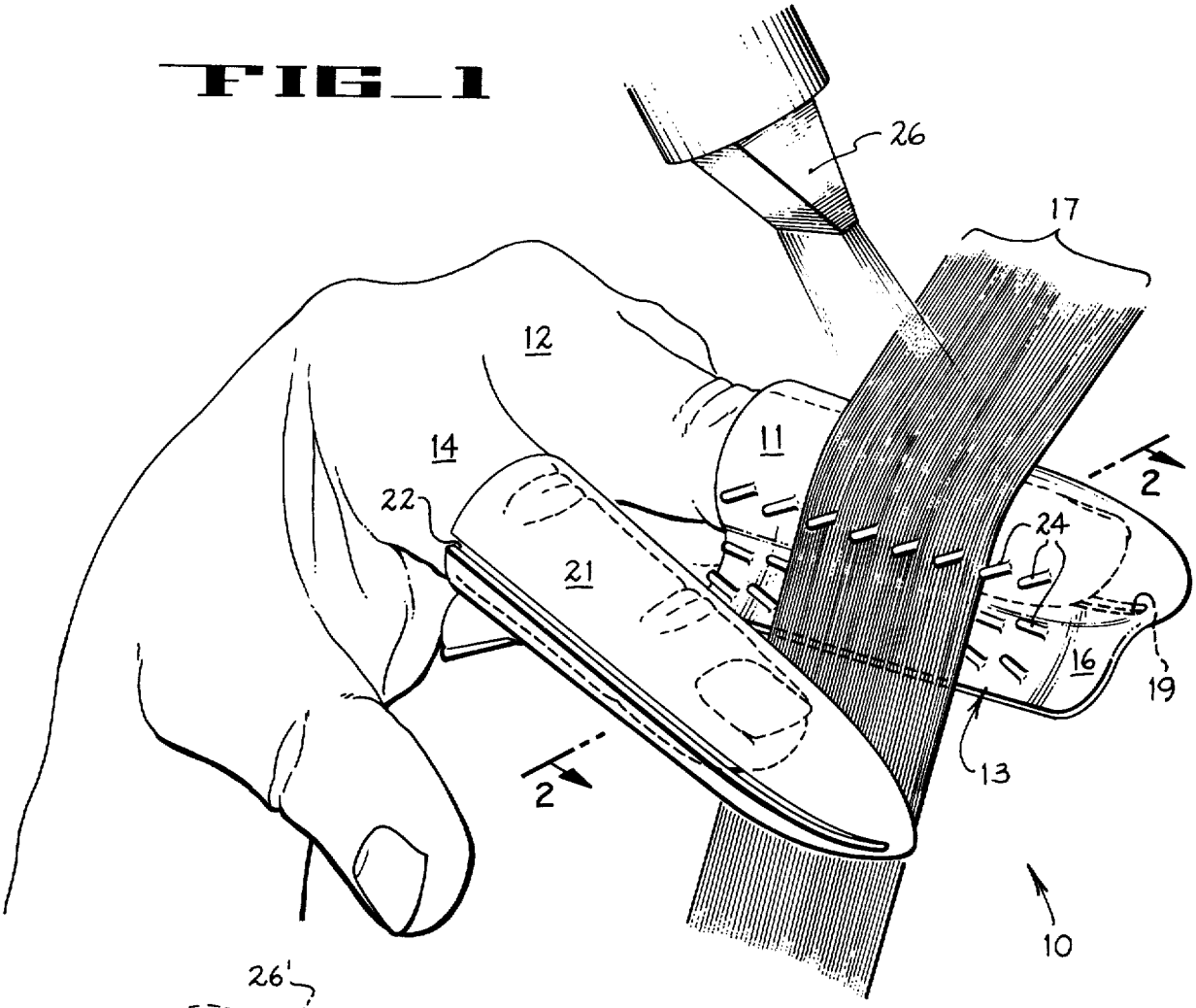
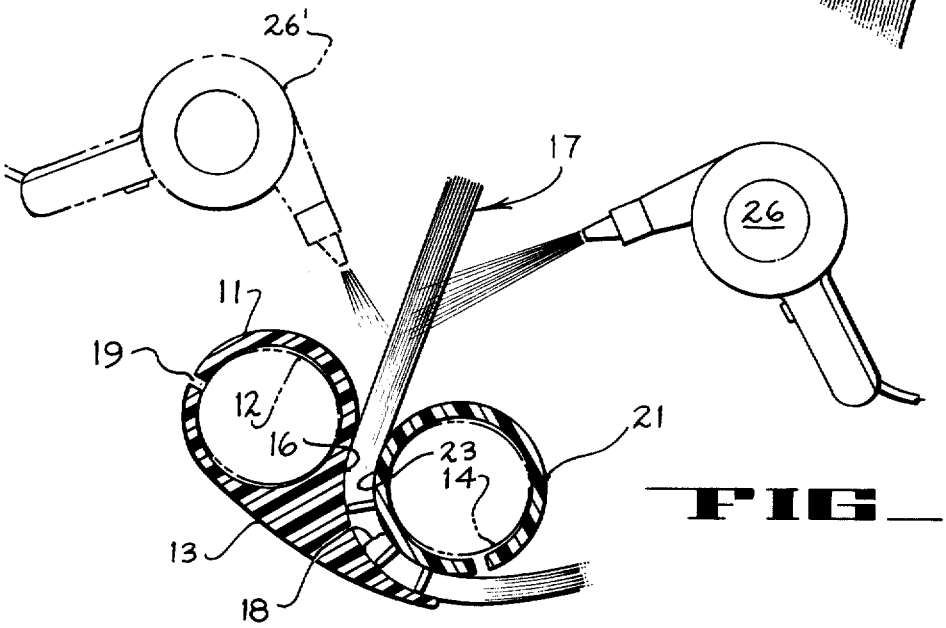
FIG_2

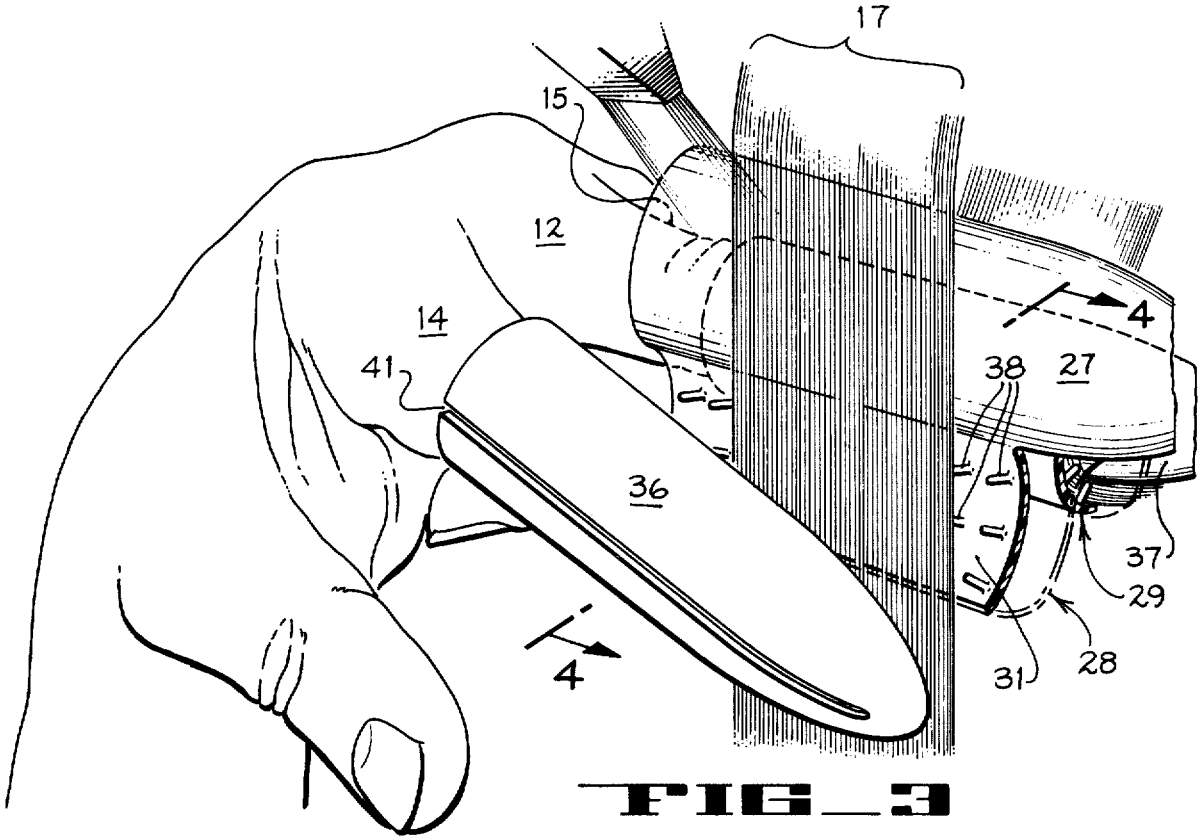
FIG_3
FIG_5
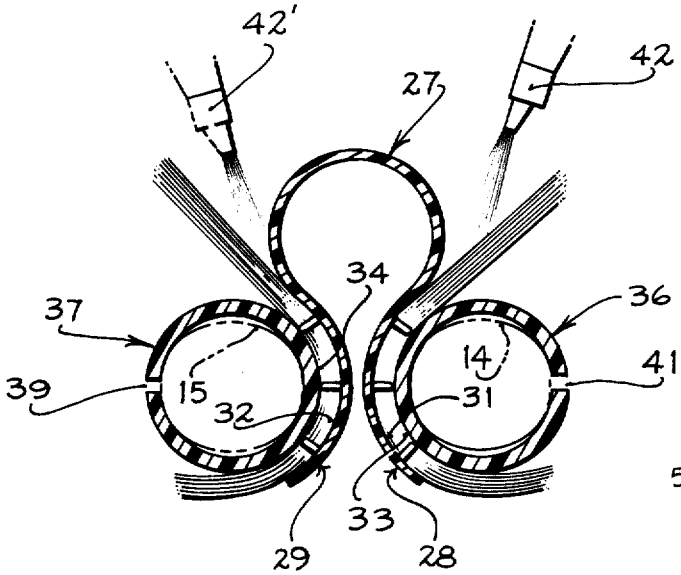
FIG_4
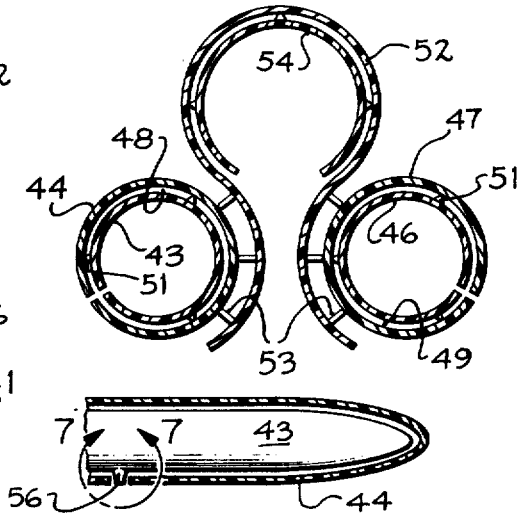
FIG_6
FIG_7
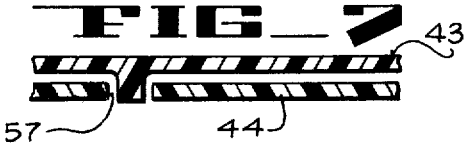

HAIR STYLING DEVICE

BACKGROUND OF THE INVENTION

This invention pertains to hair styling devices and more particularly to a hair styling device of a type adapted to be carried on the fingers of a barber's hand for use in conjunction with hot air drying guns and the like.

In the past, hair styling has been accomplished by means of a great body of devices and apparatus and recently hand-held air guns have been developed in which a hot blast of air is employed to quickly dry hair as opposed to using the more conventional hair dryers of the past. In addition, for purposes of introducing curls to the ends of hair, earlier devices, such as curling irons and more recently curlers of a type employing clips, pins and other devices for holding the curlers to hair rolled thereon have been developed.

The foregoing types of styling devices have not been entirely suitable for barbers and beauticians.

Accordingly, there has been a need for still additional improvements in the area of hair styling devices and equipment and more particularly for more simplified apparatus and devices usable with air guns of the type described and the like.

SUMMARY OF THE INVENTION AND OBJECTS

In general, there has been provided herein a hair styling device including an elongate finger covering of semi-rigid material adapted to be disposed onto a finger of a person's hand. The finger covering is formed to include an elongate curling lip carried to protrude alongside the covering while partially underlying another finger of the hand. The curling lip includes a concave surface disposed and adapted to face the other finger in generally parallel, spaced relation to flank a shock of hair when disposed therebetween. Means between the other finger and the surface of the curling lip positively establishes and maintains the spaced relation therebetween.

In general, it is an object of the invention to provide a simplified hair styling device of a type readily usable by barbers in curling the ends of the hair.

It is another object of the invention to provide a hair styling device of the kind described in which the fingers can be maintained uniformly spaced apart to a predetermined degree so as not to apply a different strain to the various portions of shocks of hair as they are being styled.

It is another object of the invention to provide a device of the kind described by which styling can be effected readily while working on either side of the customer, alternately using different pairs of fingers on the same hand.

The foregoing and other objects of the invention will become more readily evident from the following detailed description of preferred embodiments.

BRIEF DESCRIPTION OF THE DRAWINGS

FIG. 1 shows a perspective diagrammatic view of a styling device according to the invention;

FIG. 2 shows a cross-section of the styling device of FIG. 1 taken along the line 2—2 thereof (after the two fingers on the barber's hand have been closed to engage a shock of hair) and diagrammatically indicating the location of an air gun as shown drawn to a different scale;

FIG. 3 shows a perspective diagrammatic view of another embodiment according to the invention;

FIG. 4 shows a transverse section taken along the line 4—4 of FIG. 3 when all fingers have been closed together and illustrating alternative positions for use of an air gun when the air is being applied between different pairs of fingers;

FIG. 5 shows a transverse cross-section view according to another embodiment of the invention;

FIG. 6 shows a detail featuring a portion of the embodiment shown in FIG. 5; and FIG. 7 shows an enlarged detail of FIG. 6 taken along the line 7—7 thereof.

DETAILED DESCRIPTION OF PREFERRED EMBODIMENTS

The hair styling device 10 of FIG. 1 includes an elongate finger covering 11 formed of semi-rigid insulating material and adapted to be disposed onto the middle finger of the barber's hand 12. Covering 11 includes an elongate curling lip 13 carried to protrude alongside covering 11 while partially underlying another finger 14 of hand 12. Lip 13 includes a broad concave surface 16 disposed and adapted to face finger 14 in generally parallel, spaced relation so as to flank a shock 17 of hair when the shock of hair is disposed between fingers 12 and 14.

Means are provided in a position to be interposed between finger 14 and surface 16 so as to positively establish and maintain a predetermined spaced relation between the two as shown best in FIG. 2 by the reference numeral 18.

From the foregoing, it will be readily evident that covering 11 includes an elongate body having an open end and a closed end and an elongate gap 19 disposed along covering 11 at a position remote from lip 13 so as to permit radial expansion and contraction of the diameter of the body of covering 11 for fitting fingers of different sizes.

Accordingly, it is to be understood that the semi-rigid material of covering 11 is such as to provide a certain degree of expansion in response to insertion of a person's finger and the resilience of the material serves to retain covering 11 mounted upon the finger.

In addition to the above, it has been found desirable to employ another elongate finger covering 21 of semi-rigid insulating material adapted to be disposed onto finger 14 and including an elongate gap formed along one side in order to permit covering 21 to be employed on fingers of different sizes as above.

Means interposed between fingers 12 and 14 for positively establishing and maintaining a predetermined spaced relation comprises protruding elements of predetermined extent carried by covering 11 to extend toward covering 21 and serving to engage and space same therefrom so as to define a passage between the two adjacent fingers 12, 14. Passage 18 includes the confronting, substantially parallel, curved surface 16 and the surface 23 of covering 22 so that passage 18 receives the shock 17 of hair therebetween during drawing of the hair through passage 18 while curling the hair. Accordingly, the protruding elements as shown herein include prongs 24 disposed to extend laterally outwardly of curved surface 16 to define a curved imaginary surface portion substantially parallel to surface 23.

In use, each shock of hair 17 as positioned between surfaces 16, 23 is in position to be exposed to a heat gun 26 for directing a jet of heated air against same as it is drawn through the curled passage 18. In this manner a "set" is imparted to the hair which has been so treated to provide a curled end to the hair or more.

As shown in FIG. 1, the end portion of each covering 11, 21 tapers to form a conical outer end serving to permit the tip ends of the fingers to be readily passed through the hair of the customer. Further, the outer end of covering 21 extends coextensively with the outer end of covering 11 whereby a wider shock 17 of hair can be engaged for each stroke of the hair.

According to another embodiment as shown in FIGS. 3 and 4, a hair styling device includes an elongate finger covering 27 of semi-rigid material, such as plastic, adapted to be disposed onto a finger 12 of a person's hand. Finger covering 27 includes elongate curling lips 28, 29 having distal edges disposed in spaced, substantially parallel relation to the axis of a supporting finger 12 carrying covering 27. Each of lips 28, 29 includes a concave surface 31, 32 for engaging convex surfaces 33, 34 carried by fingers 14, 15 adjacent both sides of covering 27. Accordingly, a finger covering 36 of semi-rigid material and comparable to that described above relative to finger covering 21 has been provided for fingers 14, 15 whereby hair can be engaged between it and curling lips 28, 29 selectively on either side of covering 27. In this manner, barbering opposite sides of a person's head is simplified when it is desired to provide curls on both sides of the head curling outwardly, for example.

Means for maintaining a predetermined spacing between the concave surfaces of lips 28, 29 and convex surfaces of coverings 36, 37 so as to permit the shock 17 of hair to be drawn therebetween and curled while the concave and convex surfaces are closed together in mutual proximate relation comprises the prongs 38 formed in the manner of prongs 24 to define an imaginary curved surface portion parallel to surfaces 31, 32.

Finger coverings 36, 37 include an elongate hollow body having an open end and a closed end and an elongate gap 39, 41 extending along a side thereof to permit radial expansion and contraction of the diameter of the body as noted above for fitting fingers of different sizes. The closed end of each of finger coverings 36, 37 tapers to form a conical end so as to permit the body to penetrate easily through the hair.

As shown in FIG. 4, a blower in the form of a hand-held air gun 42 has been shown disposed on the right hand side of the figure for drying the shock of hair when located on that side. Also, in phantom lines, a gun 42' is shown on the left hand side for drying hair being styled on the left hand side of FIG. 4. It is readily evident that hair cannot be styled simultaneously on both sides of covering 27 and, accordingly, the showing in FIG. 4 is merely illustrative of the manner of handling hair on opposite sides of the hair styling device.

From the foregoing, it will be readily apparent that there has been provided an improved hair styling device whereby a barber's fingers will be readily protected from the relatively high heat of the newly developed air guns and in which the hair can be curled with substantially the effectiveness of a curling iron used heretofore.

It is to be understood that, as the hair is drawn downwardly as shown in the fingers, it is normally wet and, accordingly, it is an object to obtain immediate drying and curling under the conjoint action of the curvature of lips 13, 28 or 29 and the drying action of a heat gun applied at the time the hair is drawn through the passageway defined between the cooperating surface portions.

As noted above with respect to FIG. 4, sleeve 27 and sleeves 36 and 37 are of a heat-resistant plastic material for thermally protecting the fingers of a barber employing the device.

According to another embodiment (FIG. 5), coaxially disposed sleeves 43, 44 are arranged to be disposed onto a finger such as 15 and similarly arranged coaxially provided sleeves 46, 47 are disposed to be carried on finger 14. Each pair of sleeves noted above is arranged in spaced relation whereby an air gap, such as 48 or 49, may be provided along the length of the two coaxially disposed fingers.

Means are provided for disposing the inner finger in substantially parallel relation to the outer finger for maintaining an air gap along the length thereof, such as by means of the small nibs 51 which come to a relatively fine point at their radially outer extremities so as to provide a limited area for heat transfer from the outer sleeves 44, 47 to their respective inner sleeves 43, 46.

As noted above, element 27 is employed between the two sleeves 36, 37 and similarly an element 52 is provided with suitable prongs of the type noted above. Means are provided for preventing the inner sleeve 54 from rotating relative to and from falling out of sleeve 52.

Accordingly, each of the inner sleeves 43, 46, 54 is interlocked with respect to its respective outer sleeve 44, 47, 52 by means as shown in FIG. 6 wherein a laterally protruding detent element 56 engages a small hole or other opening 57 formed through the outer sleeve.

As thus arranged, it is relatively evident that for protection against the great heat generated from the nozzles of heat guns 42 directed into the interface between sleeve 52 and sleeve 47 or 44 respectively, there has been provided a captive body of air interposed between the inner and outer sleeves so as to provide far greater insulation than the thickness of the plastic material, as shown in FIG. 4.

What is claimed is:

1. A hair styling device comprising an elongate finger covering semi-rigid material adapted to be disposed onto a finger of a person's hand, said finger covering being formed to include an elongate curling lip carried to protrude alongside said covering while partially underlying another finger of said hand, said lip including a concave surface disposed and adapted to face said outer finger in generally parallel spaced relation flanking a shock of hair when disposed therebetween, and means interposed between said other finger and said surface serving to positively establish and maintain said spaced relation.

2. A hair styling device according to claim 1 in which said covering includes an elongate gap disposed along said covering at a position remote from said lip to permit radial expansion and contraction of the diameter of the body for fitting fingers of different sizes.

3. In a hair styling device according to claim 2 further comprising another elongate finger covering of semi-rigid material adapted to be disposed onto said other finger, said last named means including protruding elements of predetermined extent carried by one of said coverings to extend toward the other and serving to engage and space same therefrom to define a passage between two adjacent fingers, said passage having confronting, substantially parallel, curved surfaces for receiving and drawing hair therebetween via said passage while curling same in response to the action of the curved surfaces.

4. In a hair styling device according to claim 3 in which said protruding elements comprise prongs carried by one of said coverings to engage the other.

5. In a hair styling device according to claim 3 in which said coverings are mutually coextensive.

6. In a hair styling device comprising an elongate finger covering of semi-rigid material adapted to be disposed onto a finger of a person's hand, said finger covering being formed to include an elongate curling lip carried to protrude alongside said covering while partially underlying another finger of said hand, said lip including a concave surface disposed and adapted to face said other finger in generally parallel spaced relation to flank a shock of hair when disposed therebetween, means interposed between said other finger and said surface serving to positively establish and maintain said spaced relation, the last named means including discrete protruding elements disposed to extend laterally outwardly of said curved surface to define a curved, imaginary surface portion parallel to said first named surface.

7. In a hair styling device according to claim 6 in which said elements comprise elongate, semi-rigid prongs carried by the first named curved surface.

8. In a hair styling device comprising an elongate finger covering of semi-rigid material adapted to be disposed onto a finger of a person's hand, said covering including elongate curling lips disposed in spaced, substantially parallel relation to the axis of a supporting finger carrying said covering, each of said lips including a concave surface for engaging a convex surface carried by fingers adjacent both sides of said covering for selectively engaging a shock of hair therebetween on either side of said covering, and means for maintaining a predetermined spacing between said concave and convex surfaces to permit said shock of hair to be drawn therebetween and curled while said concave and convex surfaces are closed together in mutual proximate relation.

9. In a hair styling device according to claim 8 in which said concave surfaces are substantially coextensive and extend transversely from the axis of the first named said finger to be disposed to engage said convex surfaces.

10. In a hair styling device according to claim 8 comprising a semi-rigid finger covering to be carried on fingers adjacent the first named said finger covering including an elongate, hollow body having an open end and a closed end and an elongate gap extending along one side thereof to permit radial expansion and contraction of the diameter of said body for fitting fingers of different sizes, said closed end of said body tapering to form a conical end to permit said body to penetrate easily through the hair.

11. In a hair styling device according to claim 1 including an elongate sleeve disposed in spaced relation about the first named finger covering, and means extending therebetween to maintain said spaced relation while permitting limited heat transfer therebetween.

* * * * *